US007524231B2

(12) United States Patent
Matheny et al.

(10) Patent No.: US 7,524,231 B2
(45) Date of Patent: Apr. 28, 2009

(54) DOLL AND FACE-LICKING PUPPY COMBINATION

(75) Inventors: Kelly Matheny, Hacienda Heights, CA (US); James Molina, Riverside, CA (US)

(73) Assignee: Mattel, Inc., El Segundo, CA (US)

( * ) Notice: Subject to any disclaimer, the term of this patent is extended or adjusted under 35 U.S.C. 154(b) by 367 days.

(21) Appl. No.: 11/591,120

(22) Filed: Oct. 31, 2006

(65) Prior Publication Data

US 2007/0184750 A1 Aug. 9, 2007

Related U.S. Application Data

(60) Provisional application No. 60/731,769, filed on Oct. 31, 2005.

(51) Int. Cl.
*A63H 33/26* (2006.01)
*A63H 3/36* (2006.01)

(52) U.S. Cl. ..... 446/139; 446/129; 446/133; 446/137; 446/330; 446/337

(58) Field of Classification Search ..... 446/129, 446/131–137, 139, 313, 330, 337, 369, 372, 446/376, 391, 395
See application file for complete search history.

(56) References Cited

U.S. PATENT DOCUMENTS 2,618,099 A * 11/1952 Samet ..... 446/132
3,266,187 A * 8/1966 Felsher ..... 446/130
3,401,485 A * 9/1968 Goodrum, Jr. ..... 446/132
3,411,237 A 11/1968 Crosman
3,531,893 A 10/1970 Samo
3,867,786 A 2/1975 Greenblatt
5,071,385 A * 12/1991 Cox ..... 446/129
5,074,820 A 12/1991 Nakayama
5,181,877 A * 1/1993 Perkitny ..... 446/337
5,190,492 A 3/1993 Berenguer
5,304,087 A 4/1994 Terzian et al.
5,376,038 A 12/1994 Arad et al.
5,651,716 A 7/1997 Mowrer et al.
5,876,263 A * 3/1999 DeCesare et al. ..... 446/330
6,007,404 A 12/1999 Trevino
6,053,797 A 4/2000 Tsang et al.
6,056,619 A 5/2000 Wiggs et al.
6,062,938 A 5/2000 Meng-Suen
6,159,017 A 12/2000 Coomansingh
6,386,937 B1 5/2002 Cappello et al.
6,585,556 B2 7/2003 Smirnov
6,695,673 B1 * 2/2004 Stadbauer ..... 446/305

(Continued)

*Primary Examiner*—Derris H Banks
*Assistant Examiner*—Scott Young
(74) *Attorney, Agent, or Firm*—Roy A. Ekstrand

(57) ABSTRACT

A combination doll and toy puppy include interacting magnetic elements therein which mimic a face-licking action by the puppy. The doll includes a partially hollow head within which one or more magnets are movably supported behind the cheek portions of the doll's face. A battery-powered electric motor driven gear drive mechanism is operative within the doll's head to move the one or more magnets behind the doll's cheeks. The puppy includes a flexible extending tongue having a magnetic element supported in the end portion thereof. When the puppy is brought sufficiently close to the doll's face, the magnet in the puppy's tongue is attracted to the moving magnet within the doll's cheek area to mimic the face-licking action.

9 Claims, 2 Drawing Sheets

U.S. PATENT DOCUMENTS 6,824,441 B1 11/2004 Wiggs et al.
6,887,121 B2 5/2005 Whitehead
2002/0115376 A1 8/2002 Whitehead

* cited by examiner

DOLL AND FACE-LICKING PUPPY COMBINATION

CROSS-REFERENCE TO RELATED APPLICATION

This application claims the benefit of and priority under 35 U.S.C. 119(e) of U.S. Provisional Patent Application No. 60/731,769 entitled DOLL AND FACE-LICKING PUPPY COMBINATION filed Oct. 31, 2005 in the name of Kelly Matheny and James Molina, the disclosure of which is incorporated herein by reference.

FIELD OF THE INVENTION

This invention relates generally to toy dolls and toy puppies and particularly to interactive features operative therebetween.

BACKGROUND OF THE INVENTION

Dolls and toy plush figures such as puppies or the like are well known in the art and have been provided in a virtually endless variety. In attempting to provide evermore interesting and amusing doll and toy figure products, practitioners in the art have endeavored to provide various features and operative mechanisms therein. Thus, dolls have for example been provided having moving mouths, moving eyes, sound production and other features. Similarly, plush figures such as dogs or the like have been provided with operative mechanisms for moving their tongues, moving their eyes or making sound. In addition, practitioners in the toy arts have endeavored to provide interactive capability or cooperative action between dolls and toy figures.

For example, U.S. Pat. No. 5,181,877 issued to Perkitny sets forth an APPARATUS FOR SIMULATING A LICKING MOTION having a tongue disposed within an animal-shaped housing. The tongue is pivotally connected at one end to a main gear wheel and extends partially through an aperture in the housing. A motor and gear mechanism engage and rotate the main gear in response to a control assembly. As the main gear rotates, the tongue moves within the aperture at varying angles to simulate licking motion.

U.S. Pat. No. 6,695,673 issued to Stadbauer sets forth a MECHANICAL ANIMAL REPRODUCTION configured to resemble a dog having a head. A tongue extends through an opening in the dog head which is coupled to a drive apparatus for moving the tongue toward or away from the head to simulate "lapping" motion.

In a related art area in which magnetic elements are used in cooperation with toy figures and toy animal figures, U.S. Pat. No. 3,867,786 issued to Greenblatt sets forth a MAGNETICALLY CONTROLLED ANIMATED TOY in which an animal body such as a toy dog incorporates a magnetic control to enhance the toy. As a result, the dog is able to participate in toy activities rather than remaining passive.

U.S. Pat. No. 3,401,485 issued to Goodrum, Jr. sets forth a MAGNETICALLY ACTIVE TOY DOG having a pair of articulated forelegs hinged to the dog body and a separate piece simulating a bone having a magnet therein. A second magnet in the dog's nose interacts with the magnet in the bone causing the dog to sit up and beg in response to the action to the bone as the bone is moved relative to the dog.

U.S. Pat. No. 6,386,937 issued to Cappello, et al. sets forth a MAGNETICALLY COUPLED TOY APPARATUS having two toy components such as a doll and a nursing bottle. The nursing bottle contains a motor-driven rotating magnet in the nipple portion thereof. A second permanent magnet is mounted in a flexible region around the mouth of the doll. When the nipple containing the rotating magnet is place in proximity with the mouth of the doll, relative motion between the magnets imparts movement to the mouth and lip regions of the doll.

U.S. Pat. No. 3,411,237 issued to Crosman and U.S. Pat. No. 3,531,893 issued to Samo set forth early examples of magnetically interacting doll features.

U.S. Pat. No. 6,887,121 issued to Whitehead; U.S. Pat. No. 6,824,441 issued to Wiggs, et al.; U.S. Pat. No. 6,056,619 also issued to Wiggs, et al. and U.S. Pat. No. 6,062,938 issued to Meng-suen set forth toy apparatus in which a toy article is moved across a surface under the influence of a moving magnet beneath the surface and a cooperating magnetic element within the toy article.

Published U.S. patent application Ser. No. 2002/0115376 filed in the name of Brian Whitehead sets forth a TOY WITH MOVEMENT MEANS in which a doll is movable upon a play base and is articulated and moved both in response to cooperating magnets within the doll and proximate the base.

U.S. Pat. No. 5,304,087 issued to Terzian, et al.; U.S. Pat. No. 6,585,556 issued Smimov; U.S. Pat. No. 6,159,017 issued to Coomansingh; U.S. Pat. No. 6,053,797 issued to Tsang, et al.; U.S. Pat. No 6,007,404 issued to Trevino; U.S. Pat. No. 5,651,716 issued to Mowrer, et al.; U.S. Pat. No. 5,876,263 issued to DeCesare, et al.; U.S. Pat. No. 5,190,492 issued to Berenguer; U.S. Pat. No. 5,074,820 issued to Nakayama; and U.S. Pat. No. 5,376,038 issued to Arad, et al. set forth toy apparatus generally related to the subject matter of the present invention.

While the foregoing described toy devices have to some extent improved the toy art and in some instances enjoyed commercial success, there remains nonetheless a continuing need in the art for evermore improved, amusing and entertaining toy device combinations.

SUMMARY OF THE INVENTION

Accordingly, it is a general object of the present invention to provide an improved toy product. It is a more particular object of the present invention to provide an improved toy product which replicates interaction between a child-like doll and an animal-like toy figure. It is a still more particular object of the present invention to provide an improved toy combination which provides a human-like doll and a puppy-like toy figure in which the puppy-like toy figure appears to lick the face of the doll. In accordance with the present invention, there is provided a face-licking puppy in combination with a doll having a head and a body. The head is formed of a hollow plastic material and defines typical facial features of a human doll. The toy further includes a plush figure which resembles a typical puppy or small dog. Thus, the plush dog figure includes a body and a head formed of a plush material. The head defines typical puppy features such as eyes, nose, mouth and ears. Additionally, an elongated flexible tongue extends from the puppies mouth and supports a magnetically responsive element at the end portion thereof. A mechanism supported within the doll's head moves a pair of magnets behind the interior of the cheek portions of the dolls face. As the magnets move in response to the movement mechanism, the puppy is brought into proximity with one side of the doll such that the magnetically responsive element within the dogs tongue is attracted to the moving magnet in the proximate cheek of the doll. The movement of the magnet and the attraction between the magnetic element in the dogs tongue and the magnet cause the dogs tongue to move up and down upon the outer surface of the doll cheek simulating a licking action by the dog.

In another aspect, the present invention provides a combination doll and animal figure comprising: a doll having a head defining an interior, a face and cheek areas; a first magnetic element within the head; moving means supported within the head moving and supporting the first magnetic element proximate one of the cheek areas; an animal figure having an elongated flexible tongue; and a second magnetic element supported within the flexible tongue, the first and second magnetic elements being magnetically attractive to each other, the flexible tongue being held against the one cheek area and moved thereon by magnetic attraction between the first and second magnetic elements as the first magnetic element moves.

BRIEF DESCRIPTION OF THE DRAWINGS

The features of the present invention which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

By way of overview, the present invention doll and face-licking puppy combination provides a doll which is fabricated in accordance with general fabrication techniques and thus includes a body supporting a head. The head is formed of a rodocast hollow plastic structure and defines conventional facial features typical of dolls. A magnet drive mechanism is battery-powered and is supported within the interior of the doll's head. The magnetic drive mechanism supports a pair of moving magnets within each of the cheek portions of the doll's head proximate the interior cheek surfaces thereof. The combination also includes a plush dog figure preferably formed to resemble a puppy or small dog. The puppy includes a head and typical dog features including a mouth from which a flexible ribbon-like tongue extends. The tongue supports a magnetic element, either a magnet or a ferro magnetic metal material or other magnetically interactive material, at its end portion. When the puppy is brought into proximity with the doll's head and the magnet drive mechanism is activated, the moving magnets within the doll's cheek attract and move the end portion of the doll's tongue causing the doll tongue to appear to lick the cheek of the doll.

Figure 1:
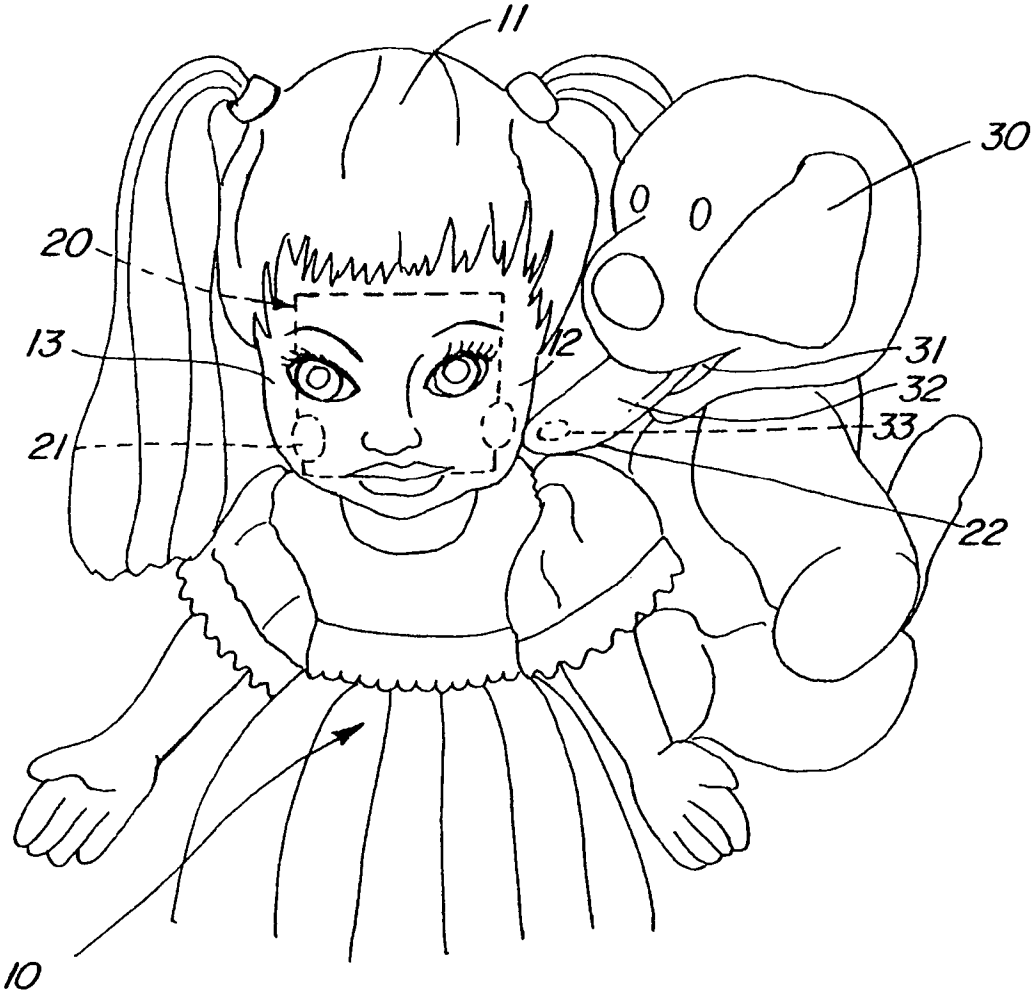
FIG. 1 sets forth a front perspective view of a doll and face-licking puppy combination constructed in accordance with the present invention.
Figure 2:
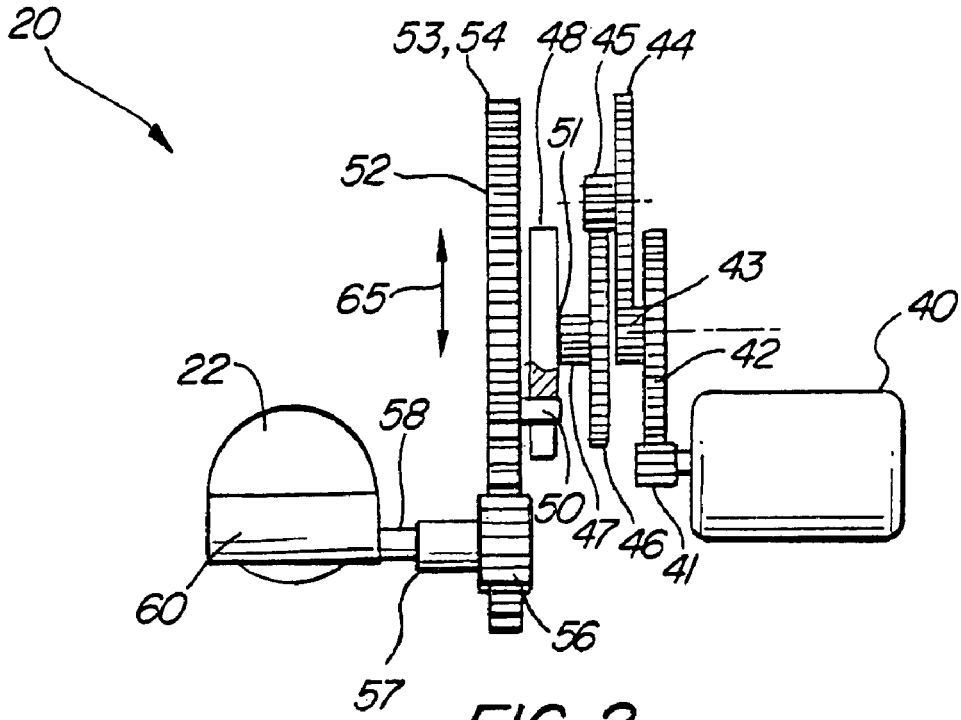
FIG. 2 sets forth an operative drawing of the magnet moving mechanism operative within the doll's head.
Figure 3:
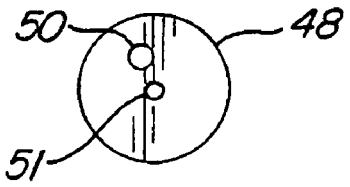
FIG. 3 sets forth a front view of the cam operative within the movement mechanism of FIG. 2.
Figure 4:
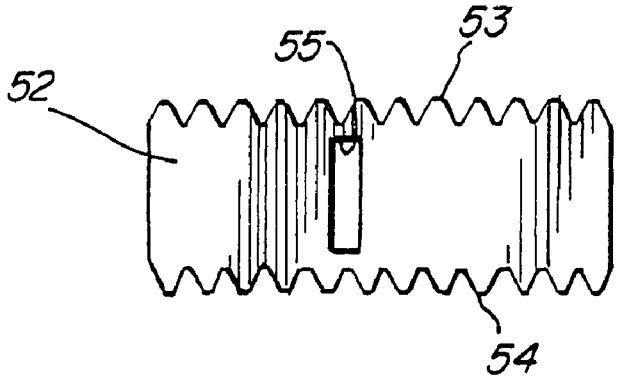
FIG. 4 sets forth a front view of the gear rack operative within the mechanism shown in FIG. 2.

More specifically, FIG. 1 sets forth a doll constructed in accordance with the present invention and generally referenced by numeral 10 together with a plush puppy figure generally referenced by numeral 30. Doll 10 includes a head 11 which is preferably fabricated in a rotocast process or other process which forms a generally hollow plastic head. Head 11 defines typical doll facial features. In accordance with the present invention, a magnet drive mechanism 20 shown in greater detail in FIGS. 2, 3 and 4 is supported within head 11 by conventional fabrication means (not shown). Doll head 11 defines a left cheek portion 12 and a right cheek portion 13. In further accordance with the present invention, magnet drive mechanism 20 supports a pair of moving magnets 21 and 22 within the interior surfaces of cheeks 13 and 12 respectively.

Figure 5:
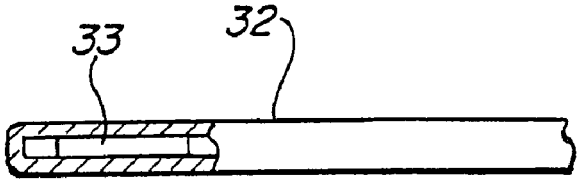
FIG. 5 sets forth a partial section view of the tongue end of the face-licking puppy used in the present invention.

Puppy 30 is formed in accordance with conventional fabrication techniques to provide a soft plush figure having a mouth 31. In accordance with the present invention, puppy 30 also includes an elongated generally ribbon-like flexible tongue. In further accordance with the present invention and as is shown in FIG. 5, tongue 32 supports a magnetically responsive element 33 at the end portion thereof. It will be apparent to those skilled in the art that any combination of magnetically attractive materials may be used for magnets 21 and 22 and element 33 of tongue 32. Thus, for example in the preferred fabrication of the present invention, magnets 21 and 22 are permanent magnets while magnetic element 33 within tongue 32 may be either a cooperating magnet or a piece of ferro magnetic metal such as steel or the like. Alternatively, however, it will be apparent to those skilled in the art that virtually any cooperating combination of magnets and/or metal elements may be used for elements 21, 22 and 33 without departing from the spirit and scope of the present invention. The important aspect with respect to the present invention is the cooperating attraction between magnetic elements one or more of which are moving within doll head 11 and one of which is supported within tongue 32.

In operation, the activation of magnet drive 20 in the manner described below causes magnets 21 and 22 to move within cheeks 13 and 12. Correspondingly, as puppy 30 is moved to the position shown in FIG. 1, magnet 22 attracts magnetic element 33 drawing the end portion of tongue 32 against cheek 12. As magnet 22 moves within cheek 12, magnetic element 33 is moved upon the outer surface of cheek 12 causing puppy 30 to appear to lick cheek 12.

While not shown in FIG. 1, it will be apparent to those skilled in the art that the positioning of puppy 30 proximate the right side of head 11 of doll 10 such that magnetic element 33 is brought against right cheek 13 produces a similar interaction between element 33 and magnet 21 and thereby causes puppy 30 to appear to lick right cheek 13. The resulting play effect is extremely realistic and very accurately simulates the licking action typical of a puppy playing with a child.

FIG. 2 sets forth an operational diagram of the mechanism operative within magnet drive 20. While not shown in FIG. 2, it will be apparent to those skilled in the art that the diagram shown in FIG. 2 is in essence "schematic" in that the conventional support apparatus within head 11 which facilitates the support and movement of the operative elements of the mechanism have been omitted for clarity. More specifically, magnet drive 20 includes a motor 40 which will be understood to be coupled to a source of battery power "not shown" and which includes an output gear 41 rotated by the action of motor 40. A plurality of speed reduction gears 42, 43, 44, 45, 46 and 47 are coupled in series combination to provide torque gain and speed reduction for the output rotational power of motor 40. Gear 47 is joined to a rotating cam 48 by a shaft 51 (better seen in FIG. 3). Thus, cam 48 rotates by direct coupling to gear 47. Cam 48 further includes an offset or eccentric post 50.

Mechanism 20 further includes a slideably supported dual gear rack 52. Gear rack 52 is better seen in FIG. 4 and thus includes a plurality of gear teeth 53 on one side thereof and a second plurality of gear teeth 54 on the remaining side thereof. As is also better seen in FIG. 4, gear rack 52 defines a transverse slot 55. Post 50 of cam 48 is received within slot 55. A gear 56 supported by a bearing 57 engages gear teeth 54. A shaft 58 is supported by baring 57 and is joined to a magnet holder 60. One or more magnets 22 are supported within magnet holder 60. As described above in FIG. 1, moveable magnet 22 is supported proximate to the interior surface of left cheek 12 of doll 10.

Magnet 21 (seen in FIG. 1) is supported on the opposite side of gear rack 52 and thus is not visible due to the side view of FIG. 2. It will be understood however that magnet 21 is supported by an identical combination of a gear engaging teeth 53 of gear rack 52 as well as a supporting bearing and shaft together with a magnet holder all of which are substantially identical to gear 56, bearing 57, shaft 58 and magnet holder 60.

In operation, energizing motor 40 rotates output gear 41 which is rotationally coupled by gears 42 through 45 to gear 46. Gear 47 is joined to gear 46 and integrally formed therewith. The rotation of gear 47 is coupled by shaft 51 to cam 48. As cam 48 rotates, post 50 is moved within slot 55 (seen in FIG. 4) causing an isolating movement of gear rack 52 in the vertical direction indicated by arrows 65. The vertical oscillation of gear rack 55 in turn causes an oscillatory rotational movement of gear 56. The motion of gear 56 is coupled to magnet 22 by shaft 58 and holder 60. Once again, while not shown in FIG. 2, it will be understood that the operative mechanism supporting magnet 21 which is identical to gear 56, bearing 57, shaft 58 and holder 60 produces a simultaneous oscillatory rotational movement of magnet 21. This rotational movement in turn produces the above-described oscillatory movements of magnets 21 and 22 within doll head 11 (seen in FIG. 1).

FIG. 3 sets forth a front view of cam 48. As described above, cam 48 supports an offset or eccentric post 50 and is coupled to gear 47 (seen in FIG. 2) by a shaft 51.

FIG. 4 sets forth a front view of dual gear rack 52. Gear rack 52 defines a plurality of gear teeth 53 in a linear gear rack on one side and a mirror image set of gear teeth 54 on the opposite side. Gear rack 52 further defines a transversely extending slot 55. It will be recalled that slot 55 receives post 50 of cam 48 (seen in FIG. 3).

FIG. 5 sets forth a partial section view of flexible tongue 32. As mentioned above, flexible tongue 32 supports a magnetic element 33. Flexible tongue 32 is preferably formed of a fabric material or the like and preferably completely encloses magnetic element 33. Magnetic element 33 may be either a ferro magnetic element such as a small disk or the like or, alternatively, element 33 may be fabricated of a permanently magnetic material. Tongue 32 must be sufficiently flexible to facilitate the movement set forth and described above in FIG. 1 to mimic the face-licking action of puppy 30.

What has been shown is a novel doll and face-licking puppy figure in combination. The combination shown provides a realistic face-licking operation between the puppy figure and the doll due to the interaction of magnetic elements within the doll and the puppies tongue. The resulting animation is extremely realistic and is accomplished in an extremely efficient and cost effective manner.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A combination doll and animal figure comprising:

a doll having a head defining an interior, a face and cheek areas;

a first magnetic element within said head;

moving means supported within said head moving and supporting said first magnetic element proximate one of said cheek areas;

an animal figure having an elongated flexible tongue; and a second magnetic element supported within said flexible tongue, said first and second magnetic elements being magnetically attractive to each other, said flexible tongue being held against said one cheek area and moved thereon by magnetic attraction between said first and second magnetic elements as said first magnetic element moves.

2. The combination doll and animal figure set forth in claim 1 wherein said moving means includes a gear drive and motor providing reciprocating movement of said first magnetic element.

3. The combination doll and animal figure set forth in claim 2 wherein said first magnetic element is a permanent magnet.

4. The combination doll and animal figure set forth in claim 3 wherein said second magnetic element is formed of a ferro magnetic metal.

5. The combination doll and animal figure set forth in claim 4 wherein said animal figure is in a shape of a small dog.

6. The combination doll and animal figure set forth in claim 5 wherein said flexible tongue is formed of a fabric material.

7. A combination doll and animal figure comprising:

a doll having a hollow head defining a cheek;

a magnet and a magnet support within said head, said magnet support including means for moving said magnet against said check;

an animal figure having an extending flexible tongue including a tongue end; and a magnetic element within said tongue end magnetically attracted to said magnet, said tongue end being attracted to said magnet and moved against said cheek as said magnet support moves said magnet.

8. The combination doll and animal figure set forth in claim 7 wherein said animal figure is in a shape of a small dog.

9. The combination doll and animal figure set forth in claim 8 wherein said flexible tongue is formed of a fabric material.

* * * * *